US010206032B2

(12) United States Patent
Alderson et al.

(10) Patent No.: US 10,206,032 B2
(45) Date of Patent: Feb. 12, 2019

(54) SYSTEMS AND METHODS FOR MULTI-MODE ADAPTIVE NOISE CANCELLATION FOR AUDIO HEADSETS

(71) Applicant: Cirrus Logic, Inc., Austin, TX (US)

(72) Inventors: Jeffrey D. Alderson, Austin, TX (US); Jon D. Hendrix, Wimberley, TX (US); Antonio J. Miller, Austin, TX (US); Robert G. Kratsas, Austin, TX (US); Jens-Peter B. Axelsson, Austin, TX (US); Dayong Zhou, Austin, TX (US); Yang Lu, Austin, TX (US); Chin Huang Yong, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 225 days.

(21) Appl. No.: 13/962,515

(22) Filed: Aug. 8, 2013

(65) Prior Publication Data

US 2014/0307888 A1 Oct. 16, 2014

Related U.S. Application Data

(60) Provisional application No. 61/810,507, filed on Apr. 10, 2013.

(51) Int. Cl.
*H04R 3/00* (2006.01)
*G10K 11/178* (2006.01)

(52) U.S. Cl.
CPC ..... *H04R 3/002* (2013.01); *G10K 11/178* (2013.01); *G10K 11/1784* (2013.01); *G10K 11/1788* (2013.01)

(58) Field of Classification Search
CPC .... H04R 1/1083; H04R 2499/11; H04R 3/00; G10K 11/178; G10K 11/16;
(Continued)

(56) References Cited

U.S. PATENT DOCUMENTS 5,117,401 A 5/1992 Feintuch
5,251,263 A 10/1993 Andrea et al.
(Continued)

FOREIGN PATENT DOCUMENTS

CN 101354885 B 1/2009
DE 102011013343 A1 9/2012
(Continued)

OTHER PUBLICATIONS

Ray et al.,"Hybrid feedforward-feedhack active noise reduction for hearing protection and communication", Jul. 8, 2006, J. Acoustic Society, Am. http://www.ncbi.nlm.nih.gov/pubmed/17069300.*
(Continued)

*Primary Examiner* — Yogeshkumar Patel
(74) *Attorney, Agent, or Firm* — Jackson Walker L.L.P.

(57) ABSTRACT

In accordance with the present disclosure, an integrated circuit for implementing at least a portion of a personal audio device may include an output and a processing circuit. The output may provide an output signal to a transducer including both a source audio signal for playback to a listener and an anti-noise signal for countering the effect of ambient audio sounds in an acoustic output of the transducer. The processing circuit may implement an adaptive noise cancellation system that generates the anti-noise signal to reduce the presence of the ambient audio sounds heard by the listener by adapting, based on a presence of the source audio signal, a response of the adaptive noise cancellation system to minimize the ambient audio sounds at the acoustic output of the transducer, wherein the adaptive noise cancellation system is configured to adapt both in the presence and the absence of the source audio signal.

63 Claims, 5 Drawing Sheets

(58) Field of Classification Search
CPC ..... G10K 11/17835; G10K 11/17861; G10K 2210/108
USPC ..... 381/71.1, 71.8
See application file for complete search history.

(56) References Cited

U.S. PATENT DOCUMENTS 5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,559,893 A 9/1996 Krokstad
5,586,190 A 12/1996 Trantow et al.
5,640,450 A 6/1997 Watanabe
5,668,747 A 9/1997 Ohashi
5,696,831 A 12/1997 Inanga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,185,300 B1 2/2001 Romesburg
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 * 9/2005 Watkins ..... G10H 1/363 381/119
7,058,463 B1 6/2006 Ruha et al.
7,103,188 B1 9/2006 Jones
7,110,864 B2 9/2006 Restrepo et al.
7,181,030 B2 2/2007 Rasmussen et al.
7,330,739 B2 2/2008 Somayajula
7,365,669 B1 4/2008 Melanson
7,368,918 B2 5/2008 Henson et al.
7,406,179 B2 7/2008 Ryan
7,441,173 B2 10/2008 Restrepo et al.
7,466,838 B1 12/2008 Moseley
7,555,081 B2 6/2009 Keele, Jr.
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,107,637 B2 1/2012 Asada et al.
8,155,334 B2 4/2012 Joho et al.
8,165,313 B2 4/2012 Carreras
8,249,262 B2 8/2012 Chua et al.
8,290,537 B2 10/2012 Lee et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,539,012 B2 9/2013 Clark
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,082,391 B2 7/2015 Yermech et al.
9,094,744 B1 7/2015 Lu et al.
9,106,989 B2 8/2015 Li et al.
9,107,010 B2 8/2015 Abdollahzadeh Milani et al.
9,203,366 B2 12/2015 Eastty
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 * 1/2004 He ..... H04B 3/23 370/286
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Czermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0018460 A1 1/2006 McCree
2006/0035593 A1 2/2006 Leeds
2006/0055910 A1 3/2006 Lee
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038447 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0208520 A1 9/2007 Zhang et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammed et al.
2008/0240455 A1 10/2008 Inoue et al.
2008/0240457 A1 10/2008 Innoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.

(56) References Cited

U.S. PATENT DOCUMENTS

2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Shridhar et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0166206 A1 7/2010 Macours
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0226210 A1 9/2010 Kordis et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Marcel et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.
2010/0322430 A1* 12/2010 Isberg ..... G10K 11/178 381/58
2011/0002468 A1 1/2011 Tanghe
2011/0007907 A1 1/2011 Park et al.
2011/0026724 A1 2/2011 Doclo
2011/0091047 A1 4/2011 Konchitsky et al.
2011/0096933 A1 4/2011 Eastty
2011/0099010 A1 4/2011 Zhang
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1* 12/2012 Kwatra ..... G10K 11/17817 381/71.11
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1 6/2013 Birch et al.
2013/0222516 A1 8/2013 Do et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0036127 A1 2/2014 Pong et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270223 A1 9/2014 Li et al.
2014/0270224 A1 9/2014 Zhou et al.
2014/0277022 A1 9/2014 Hendrix et al.
2014/0294182 A1 10/2014 Axelsson
2014/0307887 A1 10/2014 Alderson et al.
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellmann
2014/0314247 A1 10/2014 Zhang
2014/0341388 A1 11/2014 Goldstein
2014/0369517 A1 12/2014 Zhou et al.
2015/0078572 A1 3/2015 Abdollahzadeh Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0256660 A1 9/2015 Kaller et al.
2015/0256953 A1 9/2015 Kwatra et al.
2015/0269926 A1 9/2015 Alderson et al.

(56) References Cited

U.S. PATENT DOCUMENTS

| | | | |
|---|---|---|---|
| 2015/0365761 | A1 | 12/2015 | Alderson et al. |
| 2016/0180830 | A1 | 6/2016 | Lu et al. |

FOREIGN PATENT DOCUMENTS

| | | | | |
|---|---|---|---|---|
| EP | 0412902 | A2 | 2/1991 | |
| EP | 0756407 | A2 | 1/1997 | |
| EP | 0898266 | A2 | 2/1999 | |
| EP | 1691577 | A2 | 8/2006 | |
| EP | 1880699 | A2 | 1/2008 | |
| EP | 1947642 | A1 * | 7/2008 | |
| EP | 1947642 | A1 * | 7/2008 | ..... G10K 11/17817 |
| EP | 1947642 | A1 * | 7/2008 | |
| EP | 2133866 | A1 | 12/2009 | |
| EP | 2237573 | A1 | 10/2010 | |
| EP | 2216774 | A1 | 8/2011 | |
| EP | 239550 | A1 | 12/2011 | |
| EP | 2395501 | A1 | 12/2011 | |
| EP | 2551845 | A1 | 1/2013 | |
| EP | 2583074 | A1 | 4/2013 | |
| GB | 2401744 | A | 11/2004 | |
| GB | 2436657 | A | 10/2007 | |
| GB | 2455821 | A | 6/2009 | |
| GB | 2455824 | A | 6/2009 | |
| GB | 2455828 | A | 6/2009 | |
| GB | 2484722 | A | 4/2012 | |
| JP | 06006246 | | 1/1994 | |
| JP | H06186985 | A | 7/1994 | |
| JP | H06232755 | | 8/1994 | |
| JP | 07098592 | | 4/1995 | |
| JP | 07325588 | A | 12/1995 | |
| JP | H11305783 | A | 11/1999 | |
| JP | 2000089770 | | 3/2000 | |
| JP | 2002010355 | | 1/2002 | |
| JP | 2004007107 | | 1/2004 | |
| JP | 2006217542 | A | 8/2006 | |
| JP | 2007060644 | | 3/2007 | |
| JP | 2008015046 | A | 1/2008 | |
| JP | 2010277025 | | 12/2010 | |
| JP | 2011061449 | | 3/2011 | |
| WO | 1999011045 | | 3/1999 | |
| WO | 2003015074 | A1 | 2/2003 | |
| WO | 2003015275 | A1 | 2/2003 | |
| WO | WO2004009007 | A1 | 1/2004 | |
| WO | 2004017303 | A1 | 2/2004 | |
| WO | 2006125061 | A1 | 11/2006 | |
| WO | 2006128768 | A1 | 12/2006 | |
| WO | 2007007916 | A1 | 1/2007 | |
| WO | 2007011337 | A1 | 1/2007 | |
| WO | 2007110807 | A2 | 10/2007 | |
| WO | 2007113487 | A1 | 11/2007 | |
| WO | 2009041012 | A1 | 4/2009 | |
| WO | 2009110087 | A1 | 9/2009 | |
| WO | 2010117714 | A1 | 10/2010 | |
| WO | 2011035061 | A1 | 3/2011 | |
| WO | 2012075343 | A2 | 6/2012 | |
| WO | 2012107561 | A1 | 8/2012 | |
| WO | 2012119808 | A2 | 9/2012 | |
| WO | 2012134874 | A1 | 10/2012 | |
| WO | 2012166273 | A2 | 12/2012 | |
| WO | 2012166388 | A2 | 12/2012 | |
| WO | 2012166511 | A2 | 12/2012 | |
| WO | 2013106370 | A1 | 7/2013 | |
| WO | 2014158475 | A1 | 10/2014 | |
| WO | 2014168685 | A2 | 10/2014 | |
| WO | 2014172005 | A1 | 10/2014 | |
| WO | 2014172006 | A1 | 10/2014 | |
| WO | 2014172010 | A1 | 10/2014 | |
| WO | 2014172019 | A1 | 10/2014 | |
| WO | 2014172021 | A1 | 10/2014 | |
| WO | 2014200787 | A1 | 12/2014 | |
| WO | 2015038255 | A1 | 3/2015 | |
| WO | 2015088639 | A | 6/2015 | |
| WO | 2015088639 | A1 | 6/2015 | |
| WO | 2015088651 | A1 | 6/2015 | |
| WO | 2015088653 | A1 | 6/2015 | |
| WO | 2015134225 | A1 | 9/2015 | |
| WO | 2015191691 | A1 | 12/2015 | |
| WO | 2016100602 | A1 | 6/2016 | |

OTHER PUBLICATIONS

Ray et al.,"Hybrid feedforward-feedback active noise reduction for hearing protection and communication", Jul. 8, 2006, J. Acoustic Society, Am. http://www.ncbi.nlm.nih.gov/pubmed/17069300 (Year: 2006).*

International Search Report and Written Opinion of the International Searching Authority, International Patent Application No. PCT/US2014/017343, dated Aug. 8, 2014, 22 pages.

International Search Report and Written Opinion of the International Searching Authority, International Patent Application No. PCT/US2014/018027, dated Sep. 4, 2014, 14 pages.

International Search Report and Written Opinion of the International Searching Authority, International Patent Application No. PCT/US2014/017374, dated Sep. 8, 2014, 13 pages.

International Search Report and Written Opinion of the International Searching Authority, International Patent Application No. PCT/US2014/019395, dated Sep. 9, 2014, 14 pages.

International Search Report and Written Opinion of the International Searching Authority, International Patent Application No. PCT/US2014/019469, dated Sep. 12, 2014, 13 pages.

Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.

Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.

Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.

Jin, et al., "A simultaneous equation method-based online secondary path modeling algorithm for active noise control", Journal of Sound and Vibration, Apr. 25, 2007, pp. 455-474, vol. 303, No. 3-5, London, GB.

Erkelens et al., "Tracking of Nonstationary Noise Based on Data-Driven Recursive Noise Power Estimation", IEEE Transactions on Audio Speech, and Language Processing, vol. 16, No. 6, Aug. 2008.

Rao et al., "A Novel Two Stage Single Channle Speech Enhancement Technique", India Conference (INDICON) 2011 Annual IEEE, IEEE, Dec. 15, 2011.

Rangachari et al., "A noise-estimation algorithm for highly non-stationary environments" Speech Communication, Elsevier Science Publishers, vol. 48, No. 2, Feb. 1, 2006.

International Patent Application No. PCT/US2013/049407, International Search Report and Written Opinion, dated Jun. 18, 2014, 13 pages.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

Cohen, et al., "Noise Estimation by Minima Controlled Recursive Averaging for Robust Speech Enhancement", IEEE Signal Processing Letters, vol. 9, No. 1, Jan. 2002.

Martin, "Noise Power Spectral Density Estimation Based on Optimal Smoothing and Minimum Statistics", IEEE Trans. on Speech and Audio Processing, col. 9, No. 5, Jul. 2001.

Martin, "Spectral Subtraction Based on Minimum Statistics", Proc. 7th EUSIPCO '94, Edinburgh, U.K., Sep. 13-16, 1994, pp. 1182-1195.

Cohen, "Noise Spectrum Estimation in Adverse Environments: Improved Minima Controlled Recursive Averaging", IEEE Trans. on Speech & Audio Proc., vol. 11, Issue 5, Sep. 2003.

(56) References Cited

OTHER PUBLICATIONS

Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", Plos One, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, dated May 27, 2014, 11 pages.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
D. Senderowicz et al., "Low-Voltage Double-Sampled Delta-Sigma Converters," IEEE J. Solid-State Circuits, vol. 37, pp. 1215-1225, Dec. 1997, 13 pages.
P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.
Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.
Booji, P.S., Berkhoff, A.P., Virtual sensors for local, three dimensional, broadband multiple-channel active noise control and the effects on the quiet zones, Proceedings of ISMA2010 including USD2010, pp. 151-166.
Kuo, Sen and Tsai, Jianming, Residual noise shaping technique for active noise control systems, J. Acoust. Soc. Am. 95 (3), Mar. 1994, pp. 1665-1668.
Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
International Patent Application No. PCT/US2014/017112, International Search Report and Written Opinion, dated May 8, 2015, 22 pages.
International Patent Application No. PCT/US2014/049600, International Search Report and Written Opinion, dated Jan. 14, 2015, 12 pages.
International Patent Application No. PCT/US2014/061753, International Search Report and Written Opinion, dated Feb. 9, 2015, 8 pages.
International Patent Application No. PCT/US2014/061548, International Search Report and Written Opinion, dated Feb. 12, 2015, 13 pages.
International Patent Application No. PCT/US2014/060277, International Search Report and Written Opinion, dated Mar. 9, 2015, 11 pages.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, dated Oct. 18, 2014, 12 pages.
International Patent Application No. PCT/US2015/017124, International Search Report and Written Opinion, dated Jul. 13, 2015, 19 pages.
International Patent Application No. PCT/US2015/035073, International Search Report and Written Opinion, dated Oct. 8, 2015, 11 pages.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, dated Jul. 23, 2015, 13 pages.
Combined Search and Examination Report, Application No. GB1512832.5, dated Jan. 28, 2016, 7 pages.

(56) References Cited

OTHER PUBLICATIONS

International Patent Application No. PCT/US2015/066260, International Search Report and Written Opinion, dated Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, dated Apr. 21, 2016, 5 pages.
First Examination Opinion Notice, State Intellectual Property Office of the People's Republic of China, Application No. 201480033331.3, dated Aug. 24, 2018.

* cited by examiner

SYSTEMS AND METHODS FOR MULTI-MODE ADAPTIVE NOISE CANCELLATION FOR AUDIO HEADSETS

RELATED APPLICATION

The present disclosure claims priority to U.S. Provisional Patent Application Ser. No. 61/810,507, filed Apr. 10, 2013, which is incorporated by reference herein in its entirety.

FIELD OF DISCLOSURE

The present disclosure relates in general to adaptive noise cancellation in connection with an acoustic transducer, and more particularly, multi-mode adaptive cancellation for audio headsets.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

Because the acoustic environment around personal audio devices, such as wireless telephones, can change dramatically, depending on the sources of noise that are present, the position of the device itself, and a mode of operation of the audio device (e.g., phone call, listening to music, in a noisy environment with no source audio content, as an earplug, as a hearing aid, etc.), it is desirable to adapt the noise canceling to take into account such environmental changes.

SUMMARY

In accordance with the teachings of the present disclosure, certain disadvantages and problems associated with detection and reduction of ambient noise associated with an acoustic transducer may be reduced or eliminated.

In accordance with embodiments of the present disclosure, an integrated circuit for implementing at least a portion of a personal audio device may include an output and a processing circuit. The output may be for providing an output signal to a transducer including both a source audio signal for playback to a listener and an anti-noise signal for countering the effect of ambient audio sounds in an acoustic output of the transducer. The processing circuit may implement an adaptive noise cancellation system that generates the anti-noise signal to reduce the presence of the ambient audio sounds heard by the listener by adapting, based on a presence of the source audio signal, a response of the adaptive noise cancellation system to minimize the ambient audio sounds at the acoustic output of the transducer, wherein the adaptive noise cancellation system is configured to adapt both in the presence and the absence of the source audio signal.

In accordance with these and other embodiments of the present disclosure, a method for canceling ambient audio sounds in the proximity of a transducer of a personal audio device may comprise generating a source audio signal for playback to a listener. The method may also include adaptively generating an anti-noise signal to reduce the presence of the ambient audio sounds heard by the listener by adapting, based on a presence of the source audio signal, a response of an adaptive noise cancellation system to minimize the ambient audio sounds at an acoustic output of the transducer, wherein the adaptive noise cancellation system is configured to adapt both in the presence and the absence of the source audio signal. The method may further include combining the anti-noise signal with a source audio signal to generate an audio signal provided to the transducer.

In accordance with these and other embodiments of the present disclosure, a personal audio device may include a transducer and a processing circuit. The transducer may be for reproducing an audio signal including both a source audio signal for playback to a listener and an anti-noise signal for countering the effects of ambient audio sounds in an acoustic output of the transducer. The processing circuit may implements an adaptive noise cancellation system that generates the anti-noise signal to reduce the presence of the ambient audio sounds heard by the listener by adapting, based on a presence of the source audio signal, a response of the adaptive noise cancellation system to minimize the ambient audio sounds at the acoustic output of the transducer, wherein the adaptive noise cancellation system is configured to adapt both in the presence and the absence of the source audio signal.

In accordance with these and other embodiments of the present disclosure, an integrated circuit for implementing at least a portion of a personal audio device may include an output and a processing circuit. The output may provide an output signal to a transducer including both a source audio signal for playback to a listener and an anti-noise signal for countering the effect of ambient audio sounds in an acoustic output of the transducer. The processing circuit may implements an adaptive noise cancellation system that generates the anti-noise signal to reduce a presence of the ambient audio sounds heard by the listener by adapting, based on a listener-selected mode of operation, a response of the adaptive noise cancellation system to minimize the ambient audio sounds at the acoustic output of the transducer, wherein the adaptive noise cancellation system is configured to adapt both in the presence and an absence of the source audio signal.

In accordance with these and other embodiments of the present disclosure, a method for canceling ambient audio sounds in the proximity of a transducer of a personal audio device may include generating a source audio signal for playback to a listener. The method may also include adaptively generating an anti-noise signal to reduce a presence of the ambient audio sounds heard by the listener by adapting, based on a listener-selected mode of operation, a response of an adaptive noise cancellation system to minimize the ambient audio sounds at an acoustic output of the transducer, wherein the adaptive noise cancellation system is configured to adapt both in the presence and an absence of the source audio signal. The method may further include combining the anti-noise signal with a source audio signal to generate an audio signal provided to the transducer.

In accordance with these and other embodiments, a personal audio device may include a transducer and a processing circuit. The transducer may reproduce an audio signal including both a source audio signal for playback to a listener and an anti-noise signal for countering the effects of ambient audio sounds in an acoustic output of the transducer. The processing circuit may implement an adaptive noise cancellation system that generates the anti-noise signal to reduce a presence of the ambient audio sounds heard by the listener by adapting, based on a listener-selected mode of operation, a response of the adaptive noise cancellation system to minimize the ambient audio sounds at the acoustic output of the transducer, wherein the adaptive noise cancellation system is configured to adapt both in the presence and an absence of the source audio signal.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electro-acoustic path from the output of the processing circuit through the transducer.

Figure 1A:
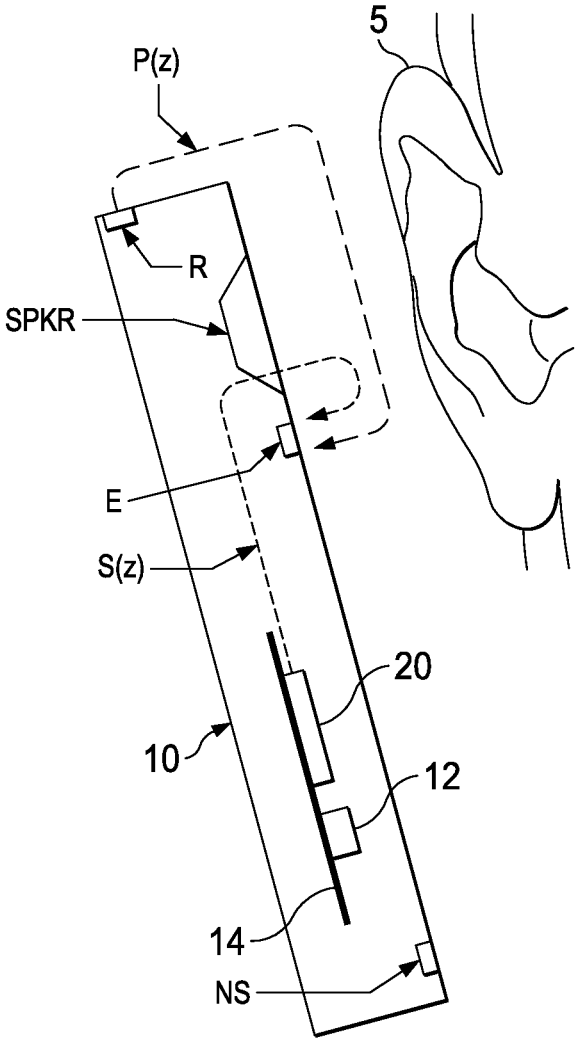
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of this disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes.

Figure 1B:
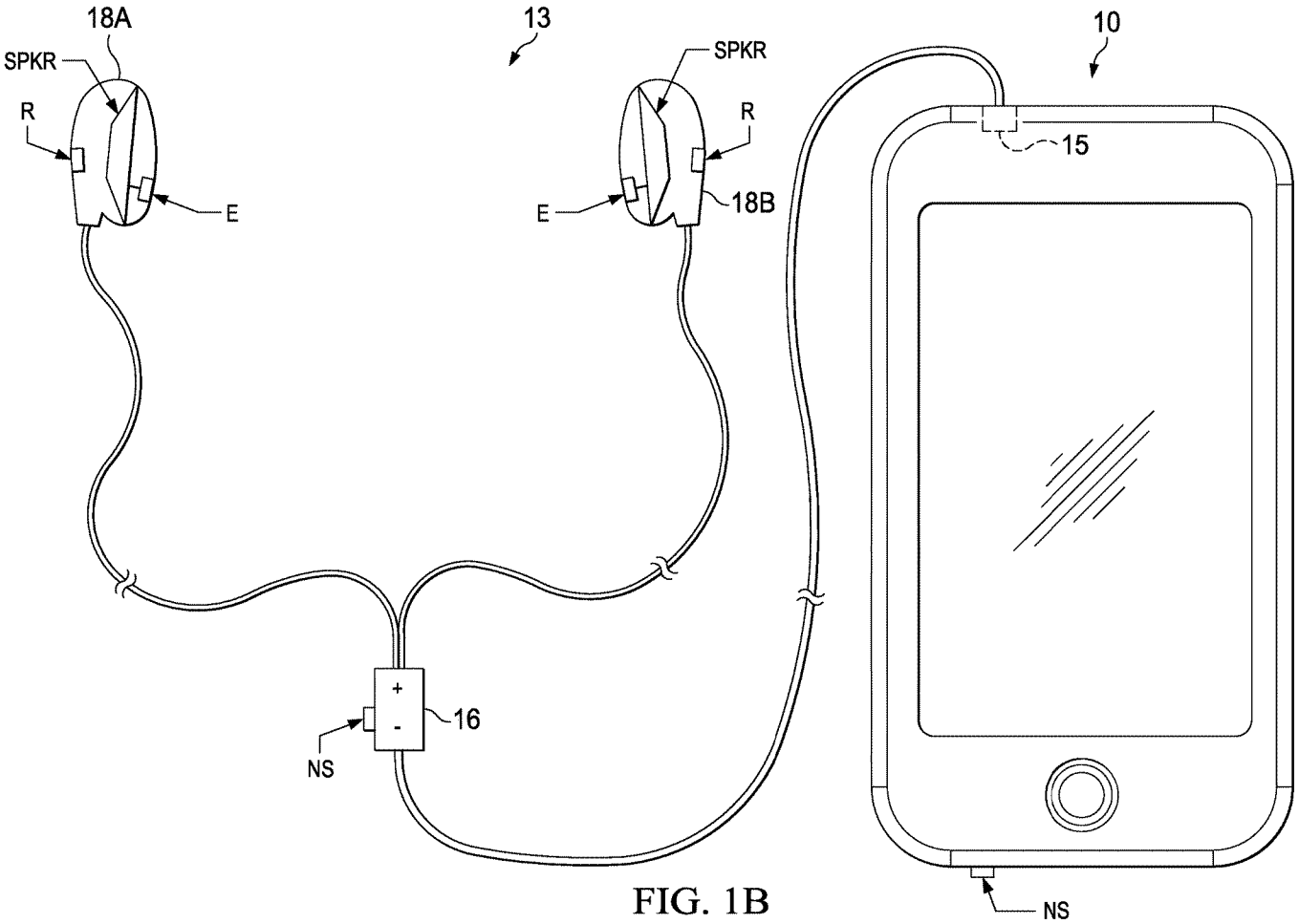
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
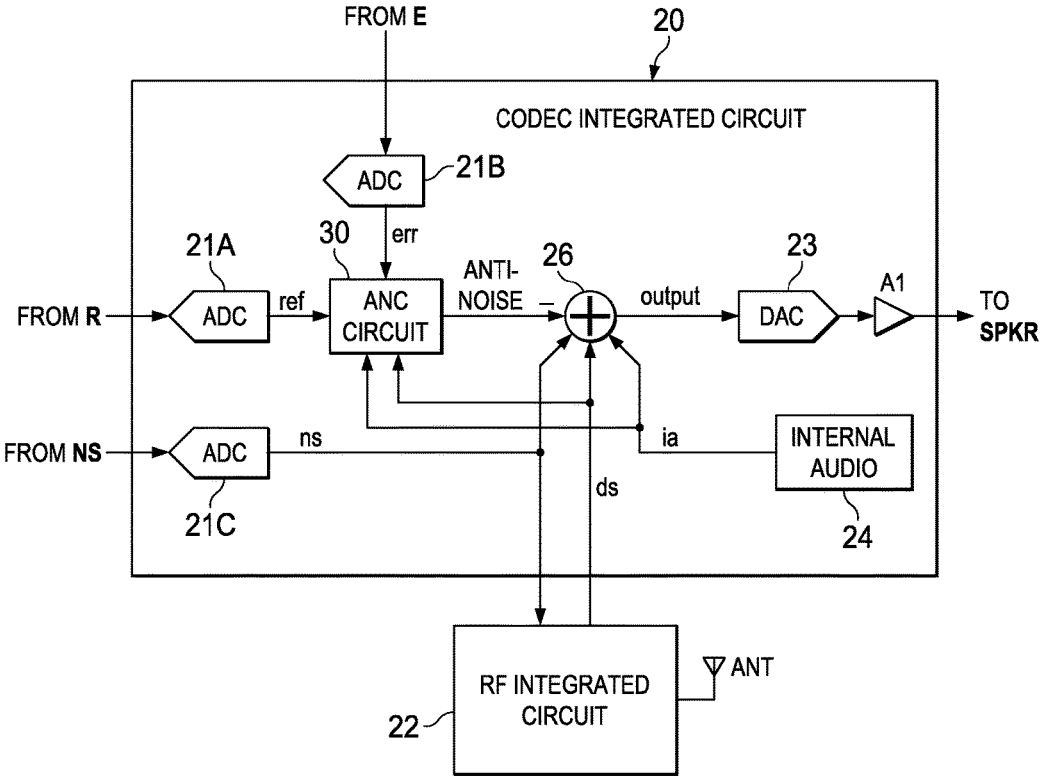
FIG. 2 is a block diagram of selected circuits within the wireless telephone depicted in FIG. 1, in accordance with embodiments of the present disclosure.

Referring now to FIG. 2, selected circuits within wireless telephone 10 are shown in a block diagram, which in other embodiments may be placed in whole or in part in other locations such as one or more headphones or earbuds. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1 , which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
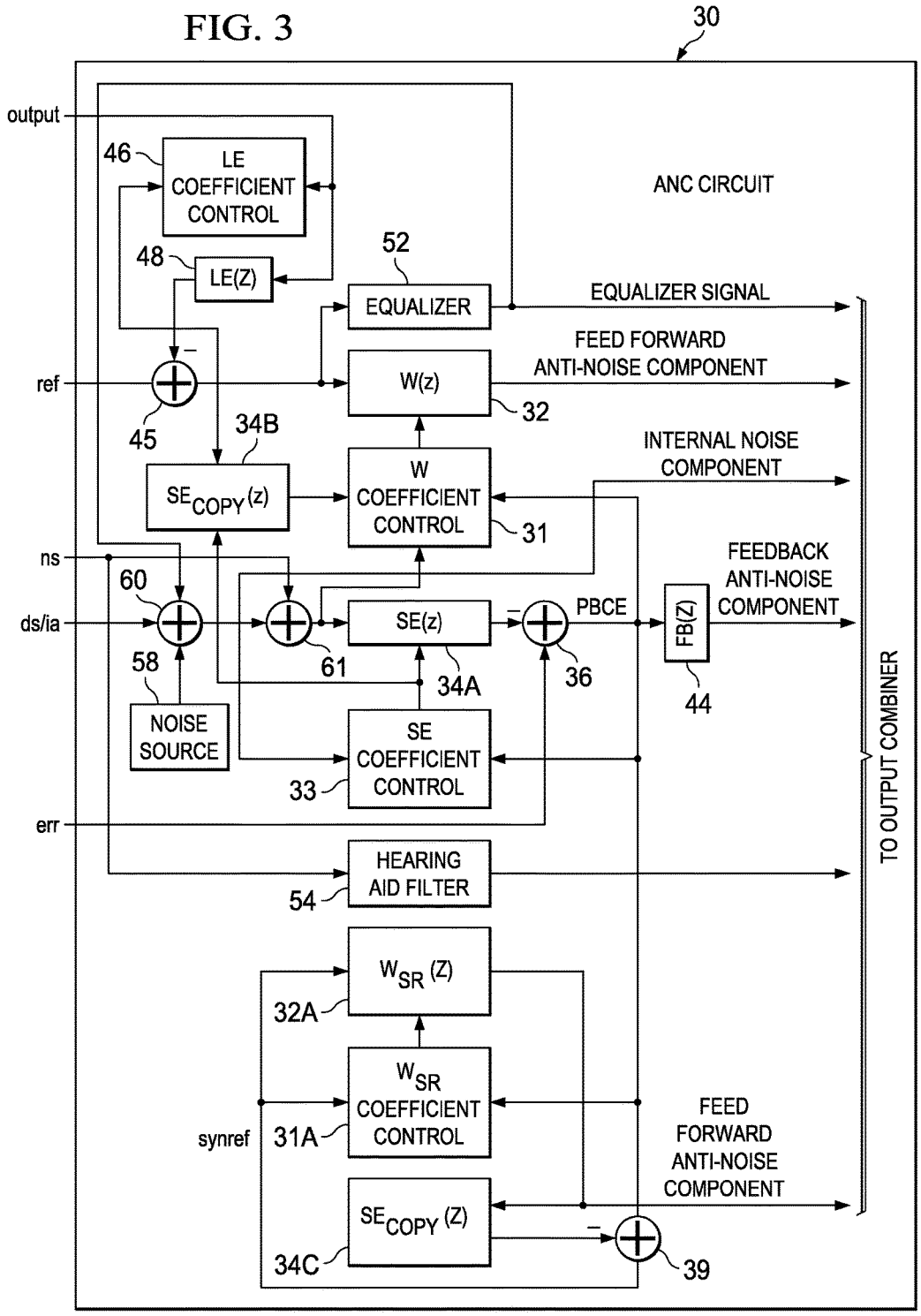
FIG. 3 is a block diagram depicting selected signal processing circuits and functional blocks within an example adaptive noise canceling (ANC) circuit of a coder-decoder (CODEC) integrated circuit of FIG. 2, in accordance with embodiments of the present disclosure.

Referring now to FIG. 3, details of ANC circuit 30 are shown in accordance with embodiments of the present disclosure. Feedforward adaptive filter 32 may receive reference microphone signal ref and under ideal circumstances, may adapt its transfer function W(z) to be P(z)/S(z) to generate a feedforward anti-noise signal component, which may be provided to an output combiner that combines the feedforward anti-noise signal component and the second feedforward anti-noise signal component described below with the audio to be reproduced by the transducer, as exemplified by combiner 26 of FIG. 2. The coefficients of feedforward adaptive filter 32 may be controlled by a W coefficient control block 31 that uses a correlation of signals to determine the response of feedforward adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err (e.g., a playback corrected error, shown as "PBCE" in FIG. 3, equal to error microphone signal err minus the source audio signal and near-speech signal ns (which may be combined with the source audio signal at combiner 61) as transformed by the estimate of the response of path S(z), response SE (z)). By transforming reference microphone signal ref with a copy of the estimate of the response of path S(z), response $SE_{COPY}(z)$, and minimizing the difference between the resultant signal and error microphone signal err, feedforward adaptive filter 32 may adapt to the desired response of P(z)/S(z). In addition to error microphone signal err, the signal compared to the output of filter 34B by W coefficient control block 31 may include an inverted amount of source audio signal (e.g., downlink audio signal ds and/or internal audio signal ia) that has been processed by filter response SE(z), of which response $SE_{COPY}(z)$ is a copy. By injecting an inverted amount of the source audio signal, feedforward adaptive filter 32 may be prevented from adapting to the relatively large amount of source audio signal present in error microphone signal err. However, by transforming that inverted copy of the source audio signal with the estimate of the response of path S(z), the source audio signal that is removed from error microphone signal err should match the expected version of the source audio signal reproduced at error microphone signal err, because the electrical and acoustical path S(z) is the path taken by the source audio signal to arrive at error microphone E. Filter 34B may not be an adaptive filter, per se, but may have an adjustable response that is tuned to match the response of adaptive filter 34A, so that the response of filter 34B tracks the adapting of adaptive filter 34A.

Adaptive filter 32A may receive a synthesized reference feedback signal synref and under ideal circumstances, may adapt its transfer function $W_{SR}(z)$ to be P(z)/S(z) to generate a second feedforward anti-noise signal component, which may be provided to an output combiner that combines the feedforward anti-noise signal component, the second feedforward anti-noise signal component, and a feedback anti-noise component (discussed in greater detail below) with the audio to be reproduced by the transducer, as exemplified by combiner 26 of FIG. 2. Thus, feedforward anti-noise component, the second feedforward anti-noise component, and the feedback anti-noise component of the anti-noise signal may combine to generate the anti-noise for the overall ANC system. Synthesized reference feedback signal synref may be generated by combiner 39 based on a difference between a signal that includes the error microphone signal (e.g., the playback corrected error) and the second feedforward anti-noise signal component as shaped by a copy $SE_{COPY}(z)$ of an estimate of the response of path S(z) provided by filter 34C. The coefficients of adaptive filter 32A may be controlled by a $W_{SR}$ coefficient control block 31A that uses a correlation of signals to determine the response of adaptive filter 32A, which generally minimizes the error, in a least-mean squares sense, between those components of synthesized reference feedback signal synref present in error microphone signal err. The signals compared by $W_{SR}$ coefficient control block 31A may be the synthesized reference feedback signal synref and another signal that includes error microphone signal err. By minimizing the difference between the synthesized reference feedback signal synref and error microphone signal err, adaptive filter 32A may adapt to the desired response of P(z)/S(z).

To implement the above, adaptive filter 34A may have coefficients controlled by SE coefficient control block 33, which may compare the source audio signal (combined with near-speech signal ns by combiner 61) and error microphone signal err after removal of the above-described filtered source audio signal, that has been filtered by adaptive filter 34A to represent the expected source audio signal delivered to error microphone E, and which is removed from the output of adaptive filter 34A by a combiner 36 to generate the playback corrected error. SE coefficient control block 33 may correlate the source audio signal with the components of the source audio signal that are present in the playback corrected error. Adaptive filter 34A may thereby be adapted to generate a signal from source audio signal, that when subtracted from error microphone signal err, equals the playback corrected error, which is the content of error microphone signal err that is not due to the source audio signal.

As depicted in FIG. 3, ANC circuit 30 may also comprise feedback filter 44. Feedback filter 44 may receive the playback corrected error signal PBCE and may apply a response FB(z) to generate a feedback anti-noise component of the anti-noise signal, which may be provided to an output combiner that combines the feedforward anti-noise component, the second feedforward anti-noise component, and the feedback anti-noise component of the anti-noise signal with the source audio signal to be reproduced by the transducer, as exemplified by combiner 26 of FIG. 2. Feedback filter 44 may comprise a loop filter in a classic feedback control loop topology. With high enough gain in a particular frequency band and without violating classic control loop stability criteria (as known to those of ordinary skill in the art and outside the scope of this disclosure) the control loop comprising feedback filter 44 may drive the playback corrected error to be as small as possible, thus achieving a certain amount of noise canceling.

Also as shown in FIG. 3, ANC circuit 30 may include a leakage estimate filter 48 with response LE(z) that models an acoustic leakage from speaker SPKR to reference microphone R which generates a leakage estimate from the output signal generated by combiner 26 of FIG. 2. Such output signal is labeled "output" on each of FIGS. 2 and 3. A combiner 45 may remove the leakage estimate from reference microphone signal ref, thus modifying reference microphone signal ref to account for acoustic leakage from speaker SPKR to reference microphone R. In the embodiments represented by FIG. 3, the response LE(z) may be adaptive, and ANC circuit 30 may include a leakage estimate coefficient control block 46 that shapes response LE(z) of the leakage estimate filter in conformity with the output signal and reference microphone signal ref after the estimated leakage has been removed to minimize acoustic leakage from speaker SPKR to reference microphone R.

In some embodiments, the amount or nature of anti-noise output to the output signal by the various elements of ANC circuit 30 may be a function of a listener-selectable setting. Although not explicitly shown in FIG. 3 for purposes of clarity and exposition, one or more control signals based on a listener-selectable setting (e.g., such setting made via a user interface of a touchscreen of wireless telephone 10 and/or combox 16) may cause one or more of filters 32, 32A, and 44 to reduce the amplitude of anti-noise generated by the respective filters (e.g., by modifying a gain of one or more of the respective filters). In addition, so that ANC circuit 30 does not attempt to adapt based on such reduced anti-noise (which may affect error microphone signal err and the playback corrected error), such one or more control signals may also cause one or more of the responses of filters 32, 32A, 34A, 34B, and 34C to cease adapting while the anti-noise is reduced.

Also as depicted in FIG. 3, ANC circuit 30 may include a noise source 58. Noise source 58 may be configured to, responsive to an absence or substantial absence of the source audio signal, inject (e.g., via combiner 60) a noise signal into one or more components of ANC circuit 30 (e.g., SE coefficient control block 33) and the output signal reproduced by speaker SPKR in place of the source audio signal such that the response of the ANC circuit 30, and in particular SE coefficient control block 33 and response SE(z) of filters 34A, 34B, and 34C, may adapt in the absence of the source audio signal In operation, adaptation of ANC circuit 30 and the anti-noise signal output to output combiner 26 may be based on a listener-selected mode of operation. For example, a listener may select (e.g., via a user interface of a touchscreen of wireless telephone 10 and/or combox 16) an earplug mode of operation indicative of a listener desire to pass attenuated audio sounds to the listener's ear. Responsive to such selection, an equalizer filter 52 may amplify one or more frequency ranges within a set of frequency ranges and may have a response that generates an equalizer signal from the reference microphone signal and injects such equalizer signal (labeled in FIG. 3 as "EQUALIZER SIGNAL) into the output signal (e.g., at combiner 26) and/or into the source audio signal (e.g., at combiner 60), such that together with the anti-noise generated by filters 32, 32*a*, and/or 44, the equalizer filter causes the ambient audio sounds to be attenuated but still audibly perceptible by the listener at an acoustic output of speaker SPKR. In addition, filters 32, 32*a*, 44 and/or other components of ANC circuit 30 may attenuate one or more frequency ranges of the reference microphone signal not within the set of frequency ranges. The set of frequency ranges may correspond to frequencies of the ambient audio sounds which are attenuated by the occlusion of an earphone 18A, 18B. Thus, ANC circuit 30 may amplify those frequencies attenuated by the occlusion of an earphone 18A, 18B while attenuating those frequencies not otherwise attenuated by the occlusion, such that all frequencies are attenuated approximately equally across the audible frequency spectrum. In some embodiments, at least one of the set of frequency ranges (e.g., the limits of the frequency range and the attenuation or amplification therein) maybe customizable by the listener (e.g., via a user interface of a touchscreen of wireless telephone 10 and/or combox 16).

As another example, a listener may select a hearing aid mode of operation indicative of a listener desire to pass amplified audio sounds to the listener's ear. Responsive to such selection, a hearing aid filter 54 may amplify the ambient audio sounds at an acoustic output of speaker SPKR while still enabling ANC circuit 30 and its various elements (e.g., filters 32, 32A, 34A, 34B, 34C, and 44) to adaptively generate anti-noise. In the embodiments represented by FIG. 3, such ambient audio sounds may be input to hearing aid filter 54 by near-speech signal ns. In other embodiments, ambient audio sounds may be injected into the source audio signal via reference microphone signal ref or another suitable microphone or sensor. In such embodiments, hearing aid filter 54 may amplify the source audio signal in order to amplify the ambient audio sounds. In addition, hearing aid filter 54 may be configured to determine (e.g., via existing noise filtering or noise cancellation techniques) which components of the injected ambient audio sounds correspond to sounds which are to be amplified (e.g., speech, music, etc.) and which ambient audio sounds are to be cancelled (e.g., background noise).

In operation, and as further described with respect to FIG. 4 below, the one or more of the various adaptive elements of ANC circuit 30, for example W coefficient control block 31, $W_{SR}$ coefficient control block 31A, and SE coefficient control block 33, may be selectively enabled and disabled from adapting their respective responses based on a presence or an absence of the source audio signal, a persistence of the source audio signal, and/or a spectral density of the source audio signal. However, regardless of whether the one or more of the various adaptive elements of ANC circuit 30 are momentarily disabled from adapting, the various adaptive elements of ANC circuit 30 are able to adapt regardless of whether the source audio signal is present.

Figure 4:
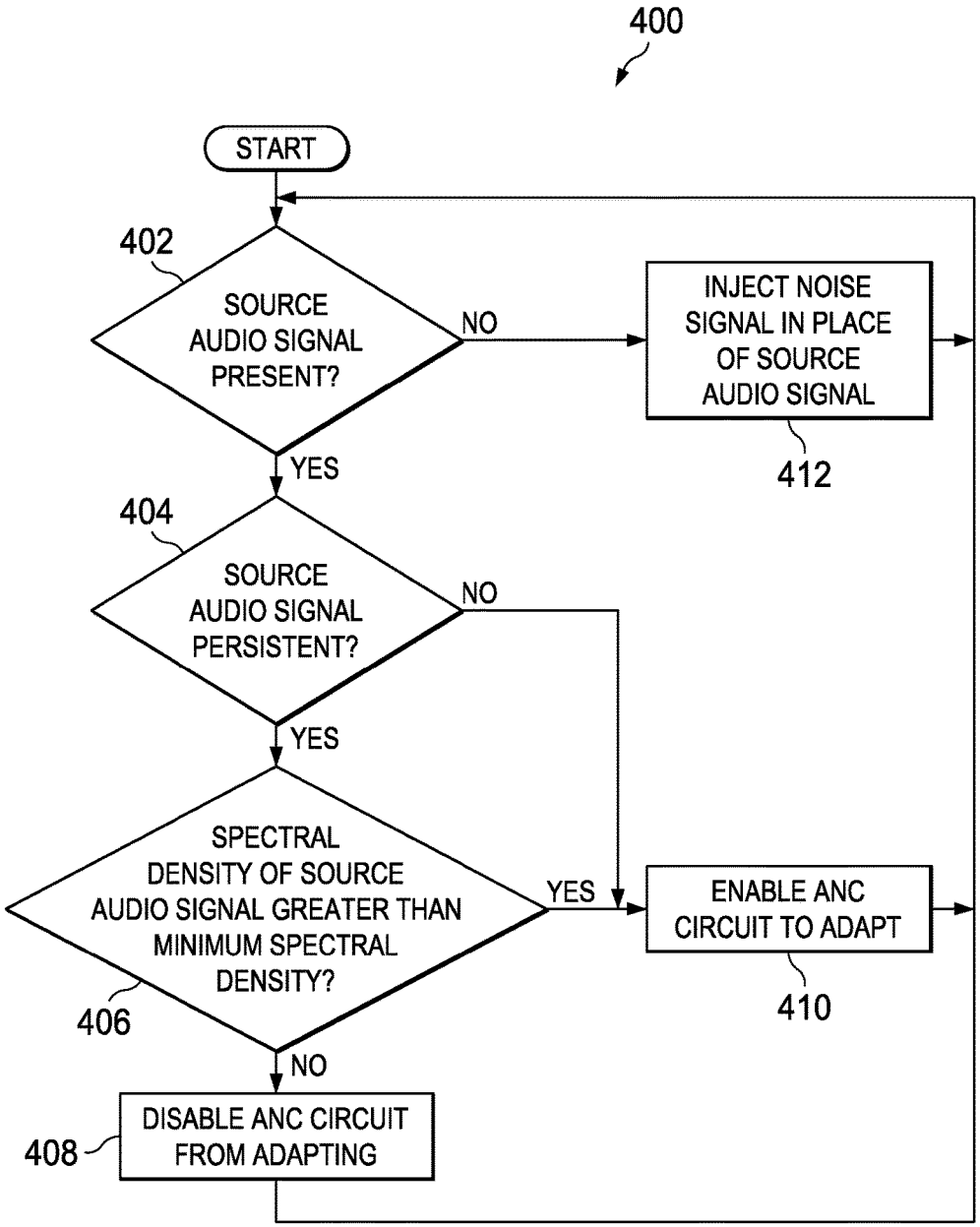
FIG. 4 is a flow chart of an example method for adapting in an adaptive noise cancellation system based on presence, persistence, and/or spectral density of a source audio signal, in accordance with embodiments of the present disclosure.

FIG. 4 is a flow chart of an example method 400 for adapting in an adaptive noise cancellation system (e.g., ANC circuit 30) based on presence, persistence, and/or spectral density of a source audio signal, in accordance with embodiments of the present disclosure. According to some embodiments, method 400 begins at step 402. As noted above, teachings of the present disclosure are implemented in a variety of configurations of wireless telephone 10. As such, the preferred initialization point for method 400 and the order of the steps comprising method 400 may depend on the implementation chosen.

At step 402, CODEC IC 20, ANC circuit 30, and/or any component thereof may determine whether a source audio signal (e.g., either downlink speech signal ds or internal audio signal ia) is present or absent. In this context, "present" or "presence" means that some substantially non-zero source audio signal content is present within a particular time interval (e.g., two seconds, ten seconds, etc.). If a source audio signal is present, method 400 may proceed to step 404. Otherwise, method 400 may proceed to step 412.

At step 404, CODEC IC 20, ANC circuit 30, and/or any component thereof may determine whether the source audio signal is persistent. In this context, "persistent" or "persistence" means that during a particular time interval (e.g., two seconds, ten seconds, etc.), the source audio signal is substantially non-zero for at least a minimum portion of such time interval. For example, downlink speech which comprises a telephone conversation is typically "bursty" in nature, and thus impersistent. As another example, internal audio comprising playback of music is typically persistent, while internal audio comprising playback of conversation (as would be the case in playback of dialogue in a film soundtrack) would typically be impersistent. If the source audio signal is persistent, method 400 may proceed to step 406. Otherwise, method 400 may proceed to step 410.

At step 406, in response to the persistence of the source audio signal, CODEC IC 20, ANC circuit 30, and/or any component thereof may enter a "playback mode" in which CODEC IC 20, ANC circuit 30, and/or any component thereof may determine whether the spectral density of the source audio signal is greater than a minimum spectral density. In this context, "spectral density" is an indication of a percentage, ratio, or similar measure of the frequencies of interest (e.g., frequencies within the range of human hearing) for which the source audio signal has substantially non-zero content at such frequencies. If the spectral density of the source audio signal is greater than a minimum spectral density, method 400 may proceed to step 410. Otherwise, method 400 may proceed to step 408.

At step 408, responsive to a determination that the source audio signal is persistent but with a spectral density lesser than the minimum spectral density, one or more of the various adaptive elements of ANC circuit 30 (e.g., W coefficient control block 31, $W_{SR}$ coefficient control block 31A, and SE coefficient control block 33) may be disabled from adapting their respective responses. After completion of step 408, method 400 may proceed again to step 402.

At step 410, responsive to a determination that the source audio signal is impersistent, CODEC IC 20, ANC circuit 30, and/or any component thereof may enter a "phone call mode" in which the various adaptive elements of ANC circuit 30 (e.g., W coefficient control block 31, $W_{SR}$ coefficient control block 31A, and SE coefficient control block 33) may be enabled to adapt their respective responses. Alternatively, responsive to a determination that the source audio signal is persistent (e.g., in a "playback mode") but with a spectral density greater than the minimum spectral density, the various adaptive elements of ANC circuit 30 (e.g., W coefficient control block 31, $W_{SR}$ coefficient control block 31A, and SE coefficient control block 33) may be enabled to adapt their respective responses. After completion of step 410, method 400 may proceed again to step 402.

Thus, in accordance with steps 404 to 410, in the event of an impersistent source audio signal (e.g., the "phone call mode"), ANC circuit 30 may have few opportunities in which the source audio signal has content sufficient to allow for efficient adaptation, and accordingly, ANC circuit 30 may adapt, regardless of the spectral density of the source audio signal. However, in the event of a persistent source audio signal (e.g., the "playback mode"), ANC circuit 30 may have many opportunities in which the source audio signal has content sufficient to allow for efficient adaptation, and accordingly, ANC circuit 30 may adapt only if the source audio signal is of a minimum spectral density, thus "waiting" for moments when spectral density of the persistent source audio signal is greater than the minimum spectral density.

At step 412, responsive to a determination that the source audio signal is absent, CODEC IC 20, ANC circuit 30, and/or any component thereof may enter an "ANC-only mode" in which noise source 58 may inject a noise signal into one or more components of ANC circuit 30 (e.g., SE coefficient control block 33) and the output signal reproduced by speaker SPKR in place of the source audio signal such that the response of the ANC circuit 30, and in particular SE coefficient control block 33 and response SE(z) of filters 34A, 34B, and 34C, may adapt in the absence of the source audio signal. The injected noise signal may be of a spectral density (e.g., broadband white noise) sufficient to allow response SE(z) to adapt over a significant range of frequencies In some embodiments, noise source 58 may inject the noise signal at an amplitude significantly below that of ambient audio sounds (e.g., ambient audio sounds as sensed by reference microphone R) such that the noise signal is substantially imperceptible to the listener. In these and other embodiments, noise source 58 may provide the noise signal substantially contemporaneously with impulsive audio sounds such that the noise signal is substantially imperceptible to the listener. As used herein, an "impulsive audio sound" may include any substantially irregular, instantaneous, and momentary ambient audio sound having an amplitude significantly greater than other ambient audio sound which may be detected by reference microphone R, another microphone, and/or any other sensor associated with the personal audio device. In these and other embodiments, noise source 58 may provide the noise signal as an audible alert perceptible to the listener (e.g., a tone or chime indicating to the user that ANC circuit 30 has entered a mode in which it is providing noise cancellation in the absence of a source audio signal).

Although FIG. 4 discloses a particular number of steps to be taken with respect to method 400, method 400 may be executed with greater or fewer steps than those depicted in FIG. 4. In addition, although FIG. 4 discloses a certain order of steps to be taken with respect to method 400, the steps comprising method 400 may be completed in any suitable order.

Method 400 may be implemented using wireless telephone 10 or any other system operable to implement method 400. In certain embodiments, method 400 may be implemented partially or fully in software and/or firmware embodied in computer-readable media and executable by a controller.

In accordance with embodiments disclosed herein, including but not limited to those of method 400, an ANC system may thus be capable of determining one or more characteristics of a source audio signal (e.g., presence, persistence, spectral density), and based on such one or more characteristics automatically select a mode of operation for the ANC system (e.g., playback mode, phone call mode, ANC-only mode) in which one or more components of the ANC system are enabled, disabled, or otherwise adjusted based on the mode of operation and/or the strategy or approach for performing adaptation of one or more adaptive components of the ANC system. In other embodiments, the mode selection may be based additionally, or alternatively, on one or more factors other than characteristics of a source audio signal. For example, in some embodiments, the characteristics of a user environment or the device itself may inform what ANC mode is most appropriate. Specifically, in one embodiment, one or more sensors may indicate that a user is running or cycling with his/her mobile device, and in response, an ANC mode be entered in which a significant portion of background noise is canceled, while still allowing the user to hear, for example, emergency vehicles or other key automobile noises (e.g., horns honking). This mode may correspond to an exercise or safety mode of ANC. It will be apparent to those having ordinary skill in the art, with the benefit of this disclosure, that a multitude of other ANC modes may be defined, which may be selected based at least in part on a predetermined criteria of characteristics sensed, predicted, or calculated by the ANC system or associated components. In some embodiments, a listener of a personal audio device including such an ANC system may be able to manually select a mode (e.g., playback mode, phone call mode, ANC-only mode) to override an otherwise automated selection of mode and/or select other modes of operation (e.g., the earplug mode or hearing aid mode described above).

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

an output for providing an output signal to a transducer including both a source audio signal for playback to a listener and an anti-noise signal for countering the effect of ambient audio sounds in an acoustic output of the transducer; and a processing circuit that implements an adaptive noise cancellation system that generates the anti-noise signal to reduce the presence of the ambient audio sounds heard by the listener by adapting, based on a presence of the source audio signal, a response of the adaptive noise cancellation system to minimize the ambient audio sounds at the acoustic output of the transducer, wherein:

the adaptive noise cancellation system is configured to adapt both in the presence and the absence of the source audio signal; and the processing circuit selectively enables and disables adaptation of the response of the adaptive noise cancellation system in the presence of the source audio signal based on at least one of a persistence of the source audio signal and a spectral density of the source audio signal, wherein a persistence of the source audio signal is a measure of a portion of a time interval in which the source audio signal is substantially non-zero.

2. The integrated circuit of claim 1, wherein responsive to a determination that the source audio signal is present and persistent, the processing circuit:

enables the response of the adaptive noise cancellation system to adapt when the spectral density of the source audio signal is greater than a minimum spectral density; and disables the response of the adaptive noise cancellation system from adapting when the spectral density of the source audio signal is lesser than the minimum spectral density.

3. The integrated circuit of claim 1, wherein responsive to a determination that the source audio signal is present and impersistent, the processing circuit enables the response of the adaptive noise cancellation system to adapt regardless of the spectral density of the source audio signal.

4. The integrated circuit of claim 1, wherein the processing circuit is configured to automatically detect the presence or the absence of the source audio signal.

5. The integrated circuit of claim 1, wherein the processing circuit further comprises a noise source for injecting a noise signal into the adaptive noise cancellation system and the output signal reproduced by the transducer in place of the source audio signal to cause the adaptive noise cancellation system to adapt in the absence of the source audio signal.

6. The integrated circuit of claim 5, wherein the noise source provides the noise signal at an amplitude below an amplitude of the ambient audio sounds such that the noise signal is substantially imperceptible to the listener.

7. The integrated circuit of claim 5, wherein the noise source provides the noise signal substantially contemporaneously with impulsive ambient audio sounds such that the noise signal is substantially imperceptible to the listener.

8. The integrated circuit of claim 5, wherein the noise source provides the noise signal as an audible alert perceptible to the listener.

9. The integrated circuit of claim 1, wherein the processing circuit outputs an amount of the anti-noise signal to the output signal as a function of a listener-selectable setting.

10. The integrated circuit of claim 9, wherein the processing circuit disables the response of the adaptive noise cancellation system from adapting responsive to a value of the listener-selectable setting being below a predetermined threshold.

11. The integrated circuit of claim 1, further comprising:

a reference microphone input for receiving a reference microphone signal indicative of the ambient audio sounds; and an error microphone input for receiving an error microphone signal indicative of the output of the transducer and the ambient audio sounds at the transducer;

wherein the processing circuit further implements:

a feedforward filter having a response that generates a feedforward anti-noise signal component from the reference microphone signal, wherein the anti-noise signal comprises at least the feedforward anti-noise signal component;

a secondary path estimate filter configured to model an electro-acoustic path of the source audio signal and have a response that generates a secondary path estimate from the source audio signal; and at least one of:

a feedforward coefficient control block that shapes the response of the feedforward filter in conformity with the error microphone signal and the reference microphone signal by adapting, based on the presence or the absence of the source audio signal, the response of the feedforward filter to minimize the ambient audio sounds in the error microphone signal; and a secondary path estimate coefficient control block that shapes the response of the secondary path estimate filter in conformity with the source audio signal and a playback corrected error by adapting, based on the presence or the absence of the source audio signal, the response of the secondary path estimate filter to minimize the playback corrected error; wherein the playback corrected error is based on a difference between the error microphone signal and the secondary path estimate.

12. The integrated circuit of claim 11, wherein the processing circuit adapts at least one of the response of the feedforward filter and the response of the secondary path estimate filter in the presence of the source audio signal based on at least one of a persistence of the source audio signal and a spectral density of the source audio signal.

13. The integrated circuit of claim 11, wherein the processing circuit further implements a noise source for injecting a noise signal into the secondary path estimate filter and the output signal reproduced by the transducer in place of the source audio signal to cause the secondary path estimate filter to adapt in the absence of the source audio signal.

14. The integrated circuit of claim 11, wherein:

the processing circuit further implements a feedback filter having a response that generates a feedback anti-noise signal component from the playback corrected error; and the anti-noise signal comprises at least the feedforward anti-noise signal component and the feedback anti-noise signal component.

15. The integrated circuit of claim 11, wherein:

the processing circuit further implements a second feedforward filter having a response that generates a second feedforward anti-noise component from a synthesized reference to reduce the presence of the ambient audio sounds heard by the listener, the synthesized reference based on a difference between the playback corrected error and at least a portion of the anti-noise signal; and the anti-noise signal comprises at least the feedforward anti-noise signal component and the second feedforward anti-noise signal component.

16. The integrated circuit of claim 15, wherein the portion of the anti-noise signal comprises the second feedforward anti-noise signal component.

17. The integrated circuit of claim 15, wherein the processing circuit further implements a second feedforward coefficient control block that shapes the response of the second feedforward filter in conformity with the playback corrected error and the synthesized reference by adapting the response of the second feedforward adaptive filter to minimize the playback corrected error.

18. The integrated circuit of claim 11, wherein the processing circuit further implements a leakage estimate filter for modeling an acoustic leakage from the transducer to the reference microphone that generates a leakage estimate from the output signal and modifies the reference microphone signal in accordance with the leakage estimate.

19. The integrated circuit of claim 18, wherein the processing circuit further implements a leakage estimate coefficient control block that shapes the response of the leakage estimate filter in conformity with the output signal and the reference microphone signal to minimize acoustic leakage from the transducer to the reference microphone.

20. The integrated circuit of claim 11, wherein the processing circuit outputs an amount of the anti-noise signal to the output signal as a function of a listener-selectable setting.

21. The integrated circuit of claim 20, wherein the processing circuit disables at least one of the feedforward coefficient control block and the secondary path estimate coefficient control block from adapting responsive to a value of the listener-selectable setting being below a predetermined threshold.

22. A method for canceling ambient audio sounds in the proximity of a transducer of a personal audio device, the method comprising:

generating a source audio signal for playback to a listener;

adaptively generating an anti-noise signal to reduce the presence of the ambient audio sounds heard by the listener by adapting, based on a presence of the source audio signal, a response of an adaptive noise cancellation system to minimize the ambient audio sounds at an acoustic output of the transducer, wherein:

the adaptive noise cancellation system is configured to adapt both in the presence and the absence of the source audio signal; and selectively enabling and disabling adaptation of the response of the adaptive noise cancellation system in the presence of the source audio signal based on at least one of a persistence of the source audio signal and a spectral density of the source audio signal, wherein a persistence of the source audio signal is a measure of a portion of a time interval in which the source audio signal is substantially non-zero; and combining the anti-noise signal with a source audio signal to generate an audio signal provided to the transducer.

23. The method of claim 22, further comprising, responsive to a determination that the source audio signal is present and persistent:

enabling the response of the adaptive noise cancellation system to adapt when the spectral density of the source audio signal is greater than a minimum spectral density; and disabling the response of the adaptive noise cancellation system from adapting when the spectral density of the source audio signal is lesser than the minimum spectral density.

24. The method of claim 22, further comprising enabling the response of the adaptive noise cancellation system to adapt regardless of the spectral density of the source audio signal responsive to a determination that the source audio signal is present and impersistent.

25. The method of claim 22, further comprising automatically detecting the presence or the absence of the source audio signal.

26. The method of claim 22, further comprising injecting a noise signal into the adaptive noise cancellation system and an output signal reproduced by the transducer in place of the source audio signal to cause the adaptive noise cancellation system to adapt in the absence of the source audio signal.

27. The method of claim 26, further comprising providing the noise signal at an amplitude below an amplitude of the ambient audio sounds such that the noise signal is substantially imperceptible to the listener.

28. The method of claim 26, further comprising providing the noise signal substantially contemporaneously with impulsive ambient audio sounds such that the noise signal is substantially imperceptible to the listener.

29. The method of claim 26, further comprising providing the noise signal as an audible alert perceptible to the listener.

30. The method of claim 22, further comprising outputting an amount of the anti-noise signal to the acoustic output of the transducer as a function of a listener-selectable setting.

31. The method of claim 30, further comprising disabling the response of the adaptive noise cancellation system from adapting responsive to a value of the listener-selectable setting being below a predetermined threshold.

32. The method of claim 22, further comprising:

receiving a reference microphone signal indicative of the ambient audio sounds; and receiving an error microphone signal indicative of the output of the transducer and the ambient audio sounds at the transducer;

wherein adaptively generating the anti-noise signal comprises:

generating a feedforward anti-noise signal component from the reference microphone signal with a feedforward filter, wherein the anti-noise signal comprises at least the feedforward anti-noise signal component;

generating a secondary path estimate from the source audio signal with a secondary path estimate filter for modeling an electro-acoustic path of the source audio signal; and at least one of:

adaptively generating the feedforward anti-noise signal component by shaping the response of the feedforward filter in conformity with the error microphone signal and the reference microphone signal by adapting, based on the presence or the absence of the source audio signal, the response of the feedforward filter to minimize the ambient audio sounds in the error microphone signal; and adaptively generating the secondary path estimate by shaping the response of the secondary path estimate filter in conformity with the source audio signal and a playback corrected error by adapting, based on the presence or the absence of the source audio signal, the response of the secondary path estimate filter to minimize the playback corrected error;

wherein the playback corrected error is based on a difference between the error microphone signal and the secondary path estimate.

33. The method of claim 32, further comprising adapting at least one of the response of the feedforward filter and the response of the secondary path estimate filter in the presence of the source audio signal based on at least one of a persistence of the source audio signal and a spectral density of the source audio signal.

34. The method of claim 32, further comprising injecting a noise signal into the secondary path estimate filter and the output signal reproduced by the transducer in place of the source audio signal to cause the secondary path estimate filter to adapt in the absence of the source audio signal.

35. The method of claim 32, further comprising generating a feedback anti-noise signal component from the playback corrected error with a feedback filter, wherein the anti-noise signal comprises at least the feedforward anti-noise signal component and the feedback anti-noise signal component.

36. The method of claim 32, further comprising generating a second feedforward anti-noise component from a synthesized reference with a second feedforward filter to reduce the presence of the ambient audio sounds heard by the listener, the synthesized reference based on a difference between the playback corrected error and at least a portion of the anti-noise signal, wherein the anti-noise signal comprises at least the feedforward anti-noise signal component and the second feedforward anti-noise signal component.

37. The method of claim 36, wherein the portion of the anti-noise signal comprises the second feedforward anti-noise signal component.

38. The method of claim 36, further comprising adaptively generating the second feedforward anti-noise signal component by shaping the response of the second feedforward filter in conformity with the playback corrected error and the synthesized reference by adapting the response of the second feedforward adaptive filter to minimize the playback corrected error.

39. The method of claim 32, further comprising:

generating a leakage estimate from an output signal of the transducer with a leakage estimate filter for modeling an acoustic leakage from the transducer to the reference microphone; and modifying the reference microphone signal in accordance with the leakage estimate.

40. The method of claim 38, further comprising adaptively generating the leakage estimate by shaping the response of the leakage estimate filter in conformity with the output signal and the reference microphone signal to minimize acoustic leakage from the transducer to the reference microphone.

41. The method of claim 32, further comprising outputting an amount of the anti-noise signal to the output signal as a function of a listener-selectable setting.

42. The method of claim 41, further comprising disabling the response of at least one of the response of the feedforward filter and the response of the secondary path estimate filter from adapting responsive to a value of the listener-selectable setting being below a predetermined threshold.

43. A personal audio device comprising:

a transducer for reproducing an audio signal including both a source audio signal for playback to a listener and an anti-noise signal for countering the effects of ambient audio sounds in an acoustic output of the transducer; and a processing circuit that implements an adaptive noise cancellation system that generates the anti-noise signal to reduce the presence of the ambient audio sounds heard by the listener by adapting, based on a presence of the source audio signal, a response of the adaptive noise cancellation system to minimize the ambient audio sounds at the acoustic output of the transducer, wherein:

the adaptive noise cancellation system is configured to adapt both in the presence and the absence of the source audio signal; and the processing circuit selectively enables and disables adaptation of the response of the adaptive noise cancellation system in the presence of the source audio signal based on at least one of a persistence of the source audio signal and a spectral density of the source audio signal, wherein a persistence of the source audio signal is a measure of a portion of a time interval in which the source audio signal is substantially non-zero.

44. The personal audio device of claim 43, wherein responsive to a determination that the source audio signal is present and persistent, the processing circuit:

enables the response of the adaptive noise cancellation system to adapt when the spectral density of the source audio signal is greater than a minimum spectral density; and disables the response of the adaptive noise cancellation system from adapting when the spectral density of the source audio signal is lesser than the minimum spectral density.

45. The personal audio device of claim 43, wherein responsive to a determination that the source audio signal is present and impersistent, the processing circuit enables the response of the adaptive noise cancellation system to adapt regardless of the spectral density of the source audio signal.

46. The personal audio device of claim 43, wherein the processing circuit is configured to automatically detect the presence or the absence of the source audio signal.

47. The personal audio device of claim 43, wherein the processing circuit further comprises a noise source for injecting a noise signal into the adaptive noise cancellation system and the output signal reproduced by the transducer in place of the source audio signal to cause the adaptive noise cancellation system to adapt in the absence of the source audio signal.

48. The personal audio device of claim 47, wherein the noise source provides the noise signal at an amplitude below an amplitude of the ambient audio sounds such that the noise signal is substantially imperceptible to the listener.

49. The personal audio device of claim 47, wherein the noise source provides the noise signal substantially contemporaneously with impulsive ambient audio sounds such that the noise signal is substantially imperceptible to the listener.

50. The personal audio device of claim 47, wherein the noise source provides the noise signal as an audible alert perceptible to the listener.

51. The personal audio device of claim 43, wherein the processing circuit outputs an amount of the anti-noise signal to the output signal as a function of a listener-selectable setting.

52. The personal audio device of claim 51, wherein the processing circuit disables the response of the adaptive noise cancellation system from adapting responsive to a value of the listener-selectable setting being below a predetermined threshold.

53. The personal audio device of claim 43, further comprising:

a reference microphone input for receiving a reference microphone signal indicative of the ambient audio sounds; and an error microphone input for receiving an error microphone signal indicative of the output of the transducer and the ambient audio sounds at the transducer;

wherein the processing circuit further implements:

a feedforward filter having a response that generates a feedforward anti-noise signal component from the reference microphone signal, wherein the anti-noise signal comprises at least the feedforward anti-noise signal component;

a secondary path estimate filter configured to model an electro-acoustic path of the source audio signal and have a response that generates a secondary path estimate from the source audio signal; and at least one of:

a feedforward coefficient control block that shapes the response of the feedforward filter in conformity with the error microphone signal and the reference microphone signal by adapting, based on the presence or the absence of the source audio signal, the response of the feedforward filter to minimize the ambient audio sounds in the error microphone signal; and a secondary path estimate coefficient control block that shapes the response of the secondary path estimate filter in conformity with the source audio signal and a playback corrected error by adapting, based on the presence or the absence of the source audio signal, the response of the secondary path estimate filter to minimize the playback corrected error; wherein the playback corrected error is based on a difference between the error microphone signal and the secondary path estimate.

54. The personal audio device of claim 53, wherein the processing circuit adapts at least one of the response of the feedforward filter and the response of the secondary path estimate filter in the presence of the source audio signal based on at least one of a persistence of the source audio signal and a spectral density of the source audio signal.

55. The personal audio device of claim 53, wherein the processing circuit further implements a noise source for injecting a noise signal into the secondary path estimate filter and the output signal reproduced by the transducer in place of the source audio signal to cause the secondary path estimate filter to adapt in the absence of the source audio signal.

56. The personal audio device of claim 53, wherein:

the processing circuit further implements a feedback filter having a response that generates a feedback anti-noise signal component from the playback corrected error; and the anti-noise signal comprises at least the feedforward anti-noise signal component and the feedback anti-noise signal component.

57. The personal audio device of claim 53, wherein:

the processing circuit further implements a second feedforward filter having a response that generates a second feedforward anti-noise component from a synthesized reference to reduce the presence of the ambient audio sounds heard by the listener, the synthesized reference based on a difference between the playback corrected error and at least a portion of the anti-noise signal; and the anti-noise signal comprises at least the feedforward anti-noise signal component and the second feedforward anti-noise signal component.

58. The personal audio device of claim 57, wherein the portion of the anti-noise signal comprises the second feedforward anti-noise signal component.

59. The personal audio device of claim 57, wherein the processing circuit further implements a second feedforward coefficient control block that shapes the response of the second feedforward filter in conformity with the playback corrected error and the synthesized reference by adapting the response of the second feedforward adaptive filter to minimize the playback corrected error.

60. The personal audio device of claim 53, wherein the processing circuit further implements a leakage estimate filter for modeling an acoustic leakage from the transducer to the reference microphone that generates a leakage estimate from the output signal and modifies the reference microphone signal in accordance with the leakage estimate.

61. The integrated circuit of claim 60, wherein the processing circuit further implements a leakage estimate coefficient control block that shapes the response of the leakage estimate filter in conformity with the output signal and the reference microphone signal to minimize acoustic leakage from the transducer to the reference microphone.

62. The personal audio device of claim 53, wherein the processing circuit outputs an amount of the anti-noise signal to the output signal as a function of a listener-selectable setting.

63. The personal audio device of claim 62, wherein the processing circuit disables at least one of the feedforward coefficient control block and the secondary path estimate coefficient control block from adapting responsive to a value of the listener-selectable setting being below a predetermined threshold.

* * * * *